US009498879B1

(12) United States Patent
Morad et al.

(10) Patent No.: US 9,498,879 B1
(45) **Date of Patent: *Nov. 22, 2016**

(54) QUICK RELEASE CLEANING TOOL

(71) Applicants: Fred I. Morad, Toluca Lake, CA (US); George Mardres, La Crescenta, CA (US)

(72) Inventors: Fred I. Morad, Toluca Lake, CA (US); George Mardres, La Crescenta, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/887,107

(22) Filed: Oct. 19, 2015

(51) Int. Cl.

| | |
|---|---|
| ***A46B 5/00*** | (2006.01) |
| ***B25G 3/26*** | (2006.01) |
| ***B25G 3/12*** | (2006.01) |
| *B25G 1/06* | (2006.01) |
| *B25G 1/04* | (2006.01) |
| *B25G 3/00* | (2006.01) |

(52) U.S. Cl.
CPC . *B25G 3/26* (2013.01); *B25G 3/12* (2013.01); *A46B 5/00* (2013.01); *B25G 1/04* (2013.01); *B25G 1/06* (2013.01); *B25G 3/00* (2013.01)

(58) Field of Classification Search
CPC ..... A47K 7/08; A47K 7/028; B25G 3/00; B25G 3/12; A46B 5/0095
USPC ..... 15/145
See application file for complete search history.

(56) References Cited

U.S. PATENT DOCUMENTS

| | | | | |
|---|---|---|---|---|
| 6,152,635 | A * | 11/2000 | Wu | A46B 5/0095 15/172 |
| 7,386,910 | B2 * | 6/2008 | Minkler | A47L 13/16 15/145 |
| 7,908,701 | B1 * | 3/2011 | Aiyar | A46B 7/02 15/115 |
| 8,214,963 | B2 * | 7/2012 | Yu | A47L 13/14 15/119.1 |
| 8,272,093 | B2 * | 9/2012 | Wu | A47L 13/255 15/228 |
| 8,312,587 | B2 * | 11/2012 | Chen | A47L 13/142 15/228 |
| 8,677,547 | B1 * | 3/2014 | Morad | H04L 51/32 15/147.1 |
| 8,689,388 | B1 * | 4/2014 | Morad | A47L 13/146 15/119.2 |
| 9,072,419 | B1 * | 7/2015 | Morad | A47L 13/24 |
| 9,161,670 | B1 * | 10/2015 | Morad | A47L 13/144 |
| 2008/0016636 | A1 * | 1/2008 | Morris | B25G 3/28 15/145 |
| 2012/0192373 | A1 * | 8/2012 | Chen | A47L 13/58 15/228 |

* cited by examiner

*Primary Examiner* — Michael Jennings
(74) *Attorney, Agent, or Firm* — Thomas I. Rozsa

(57) ABSTRACT

A mechanism by which a user can switch between cleaning tools such as brooms, brushes, and mops while utilizing the same handle. This invention allows the user to reuse the same handle as opposed to having a separate long handle for each cleaning tool. A quick release mechanism that functions by use of a transverse spring and a vertical compression spring allows the user to switch between the cleaning tools quickly and easily.

5 Claims, 14 Drawing Sheets

QUICK RELEASE CLEANING TOOL

BACKGROUND OF THE INVENTION

1. Field of the Invention

The present invention relates to cleaning tools. Specifically, this invention relates to cleaning tools with long handles such as brooms, scrub brushes, and mops. The present invention involves the field of quickly removing a first cleaning tool from a retaining member and replacing it with a second cleaning tool chosen from a group of cleaning tools.

2. Description of the Prior Art

The inventors of the present invention are also co-inventors of pending patent application Ser. No. 14/595,134 filed on Jan. 12, 2015 and entitled "SPONGE ROLLER MOP WITH QUICK RELEASE MECHANISM TO REMOVE A DIRTY SPONGE FROM THE HOUSING WITHOUT HAVING TO TOUCH THE DIRTY OR CONTAMINATED SPONGE", currently co-pending and issuing as U.S. Pat. No. 9,161,670 on Oct. 20, 2015; and co-pending patent application Ser. No. 14/852,525 filed on Sep. 12, 2015 entitled "SPONGE ROLLER MOP WITH QUICK RELEASE MECHANISM TO REMOVE A DIRTY SPONGE FROM A HOUSING WITHOUT HAVING TO TOUCH THE DIRTY OR CONTAMINATED SPONGE ALSO INCLUDING A SHOTGUN SPONGE WRINGING MECHANISM."

The present invention and the inventions disclosed and claimed in the above two co-pending patent applications have similar quick release mechanisms. The closest relevant prior art of which the present inventors are aware is set forth in the above two co-pending patent applications, either disclosed to the Patent Office by the present inventors or cited by the patent examiner during the prosecution of the two cited co-pending patent applications.

Therefore, there is a significant need for an improved invention which will enable a user to have different cleaning tools affixed to different attaching members which incorporate a portion of the quick release mechanism attachments and which can be removably retained by a second portion of the quick release mechanism which second portion is also affixed to a handle.

SUMMARY OF THE INVENTION

This invention allows a user to replace a cleaning tool affixed to a cleaning tool holder which in turn is molded to a quick release pin. The quick release pin is removably retained by a quick release mechanism retained in a housing. The housing may be a cylindrical housing and is affixed to a handle member at a location distant from where the quick release pin is inserted into the quick release mechanism retained in the cylindrical housing. The cleaning tools are selected from the group consisting of a scrub brush, a deck mop, a push broom, a flat mop and a straw broom. The quick release mechanism combined with the quick release pin enables a user to rapidly switch between different cleaning tools. This allows the user to only handle the housing enclosing the quick release mechanism as opposed to having separate handles for each cleaning tool.

The quick release pin is affixed to a cleaning tool holder. The quick release mechanism includes a transverse section having a movable pushbutton which includes a body having a transverse opening through which the crown of the quick release pin is inserted. The quick release pin is retained in a gap formed between a lower surface of a crown and an upper surface of a lower cylindrical member. A narrower intermediate cylindrical section between the crown and the lower cylindrical member creates the gap. The pushbutton is moved in a transverse direction through a transverse spring which creates a transverse force so that a portion of the wall of the opening in the body of the transverse section is retained within the gap between the crown and a lower cylindrical section of the quick release pin to thereby retain the crown of the quick release pin within the quick release mechanism.

In addition, the crown pushes against an internal vertical piston which then pushes against a vertical compression spring retained within a housing of the quick release mechanism. When this action occurs, the vertical compression spring is pushed into a compressed condition. Concurrently, there is a transverse pushbutton which contains through its thickness an opening having a sidewall which is aligned with the internal vertical piston, the pushbutton forced into this condition by force of a transverse coil spring retained between a proximal face of the pushbutton body and an interior wall of the cylindrical housing. As a result, when the crown of the quick release pin is pushed through the hole, the sidewall of the hole through the force of the transverse spring causes a portion of the sidewall to be retained in the gap of a quick release pin, the gap located between a lower surface of the crown and an upper surface of a lower cylindrical member of the quick release pin. Therefore, the trigger mechanism of the present invention is in the locked condition.

In order to release the quick release pin, the pushbutton release mechanism is pushed to overcome the transverse spring force and the portion of the crown that was retained in the opening or hole of the pushbutton body is released. The pushbutton release mechanism is pushed at a distal end in a transverse direction to overcome the force of the transverse coil spring so that the crown of the quick release pin is aligned with the hole in the pushbutton body and thereafter the force of the vertical compressed coil spring forces the quick release pin out of the opening and out of the quick release mechanism so that the cleaning tool holder and quick release pin are pushed to a released condition by the force of the uncompressed vertical coil spring. Thereafter a different cleaning tool affixed to a different tool holder having a quick release pin is inserted into the quick release mechanism.

It is an object of the present invention to create numerous variations on the cleaning tool attachments. These attachments can be a multiplicity of different cleaning tools ranging from brooms to mops to brushes or any other cleaning tool.

It is another object of the present invention to have a cylindrical housing retaining a pushbutton quick release mechanism that attaches at one end to a handle and at the other end has an opening to receive a quick release pin affixed to a cleaning tool holder retaining a cleaning tool. Each cleaning tool has a cleaning tool brace or holder with a quick release pin incorporated therein and inserted into the pushbutton release mechanism to cause the quick release pin to be retained and quickly released without having to touch the cleaning tools.

It is a further object of the present invention to eliminate the need for having separate handles for each cleaning tool. The present invention eliminates this requirement by having a number of cleaning tool attachments that readily attach to the cylindrical housing affixed to the handle at one end and which incorporate the present invention quick release mechanism adjacent the opposite end.

It is another object of the present invention to have a multitude of cleaning tool attachments that can be easily and readily removed and added as needed without touching the cleaning tool attachment. The functioning of the quick release pin and the cylindrical housing will allow a user to remove and add an attachment by holding the handle and pushing the pushbutton release. Similarly, an attachment can be added by grasping the handle and allowing the quick release pin affixed to the cleaning tool brace to enter the cylindrical housing and be locked into place.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
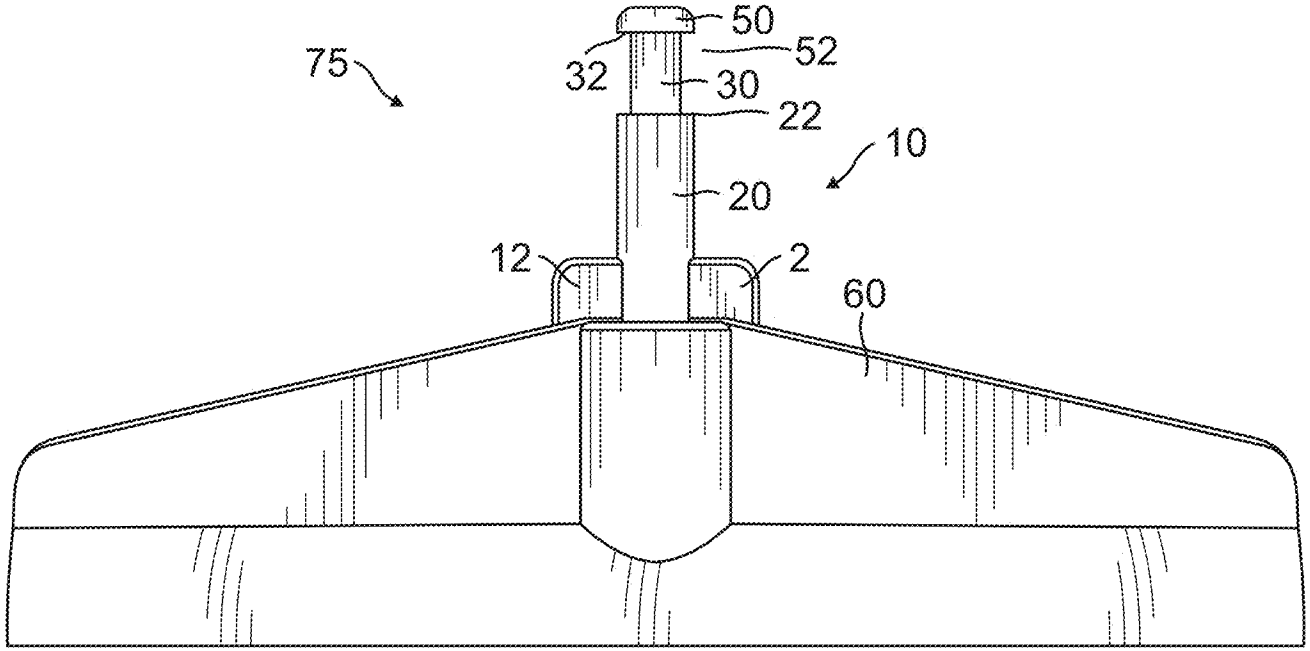
FIG. 1 is a front elevational view of a cleaning tool holder or bracket incorporating the quick release pin of the present invention.
Figure 2:
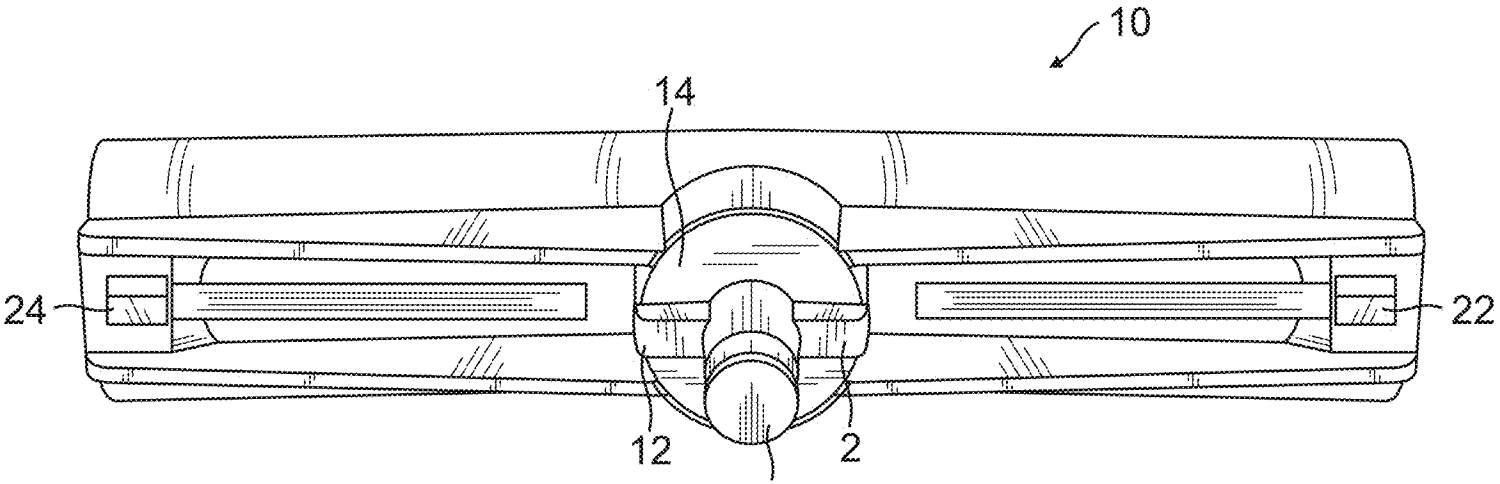
FIG. 2 is a top perspective view of a cleaning tool holder or bracket incorporating the quick release pin of the present invention.
Figure 3:
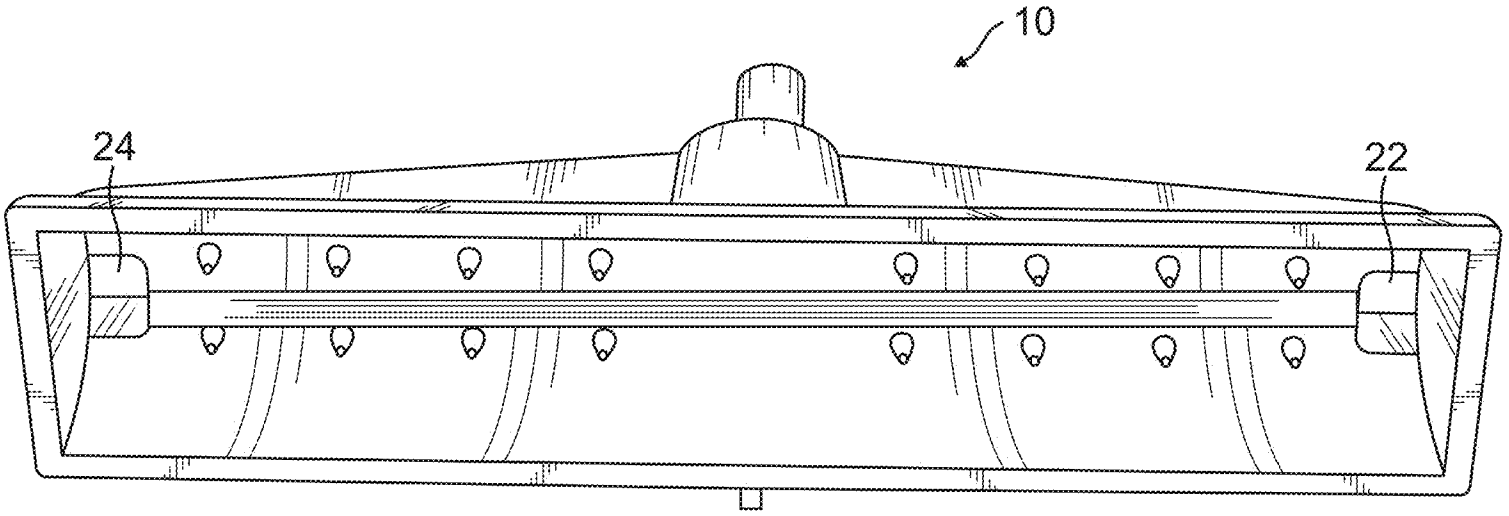
FIG. 3 is a bottom perspective view of a cleaning tool holder or bracket incorporating the quick release pin of the present invention.
Figure 4:
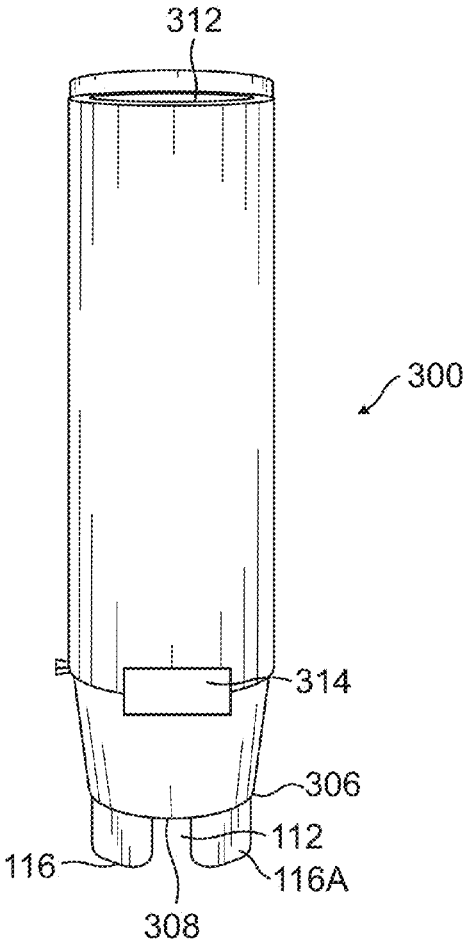
FIG. 4 is a front perspective view of the cylindrical housing for the present invention with the pushbutton release mechanism removed.
Figure 5:
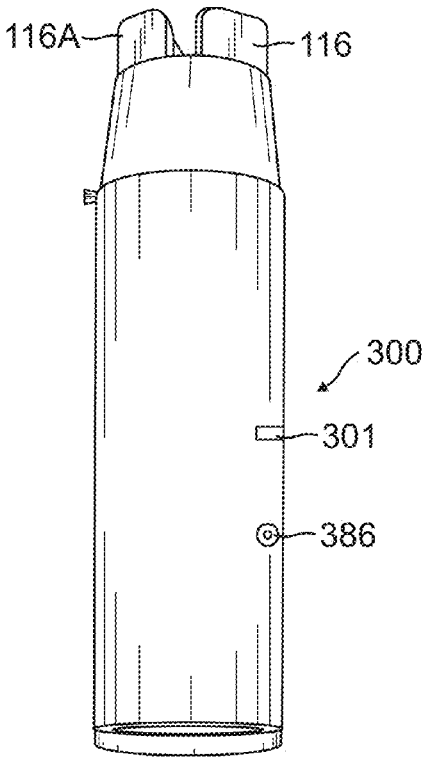
FIG. 5 is a rear perspective view of the cylindrical housing for the present invention.

Referring to FIG. 1, there is illustrated a front elevational view of a cleaning tool holder or bracket 75 incorporating the quick release pin 10 of the present invention. FIG. 2 illustrates a top perspective view of a cleaning tool holder or bracket 75 incorporating the quick release pin 10 of the present invention. FIG. 3 is a bottom perspective view of a cleaning tool holder or bracket 75 incorporating the quick release pin 10 of the present invention. The quick release pin 10 includes a lower cylindrical member 20 incorporated into the cleaning tool holder 60. As illustrated in FIGS. 4 and 5, the cylindrical housing 300 retaining the quick release mechanism into which the quick release pin 10 is inserted has bottom posts 116 and 116A which rest against base 14 and has a slot 112 between the posts 116 and 116A. Slot 112 is inserted over anti-rotational wings 2 and 12 to prevent the housing 300 from rotating. Referring back to FIGS. 1 through 3, openings 22 and 24 extend through cleaning tool holder 75 and receive cleaning tool retainers to retain a cleaning tool to the cleaning tool holder 60. The lower cylindrical member 20 extends to an upper cylindrical member 30 which extends to a crown 50. A gap 52 is between the bottom surface 32 of crown 50 and upper surface 22 of lower cylindrical member 20. The thickness or diameter of the upper cylindrical member 30 is less than the diameter of bottom surface 32 of crown 50 and the top surface 22 of the lower cylindrical member 20 (22 and 32 optionally may have the same diameter), thereby creating the gap 52.

The innovation of the present invention is the quick release pin 10 and the quick release mechanism to be described which removably retains the quick release pin 10 which is molded into the cleaning tool holder 60. Examples of some of the cleaning tools retained by a respective one cleaning tool holder 60 are illustrated in FIGS. 10 through 14.

Figure 10:
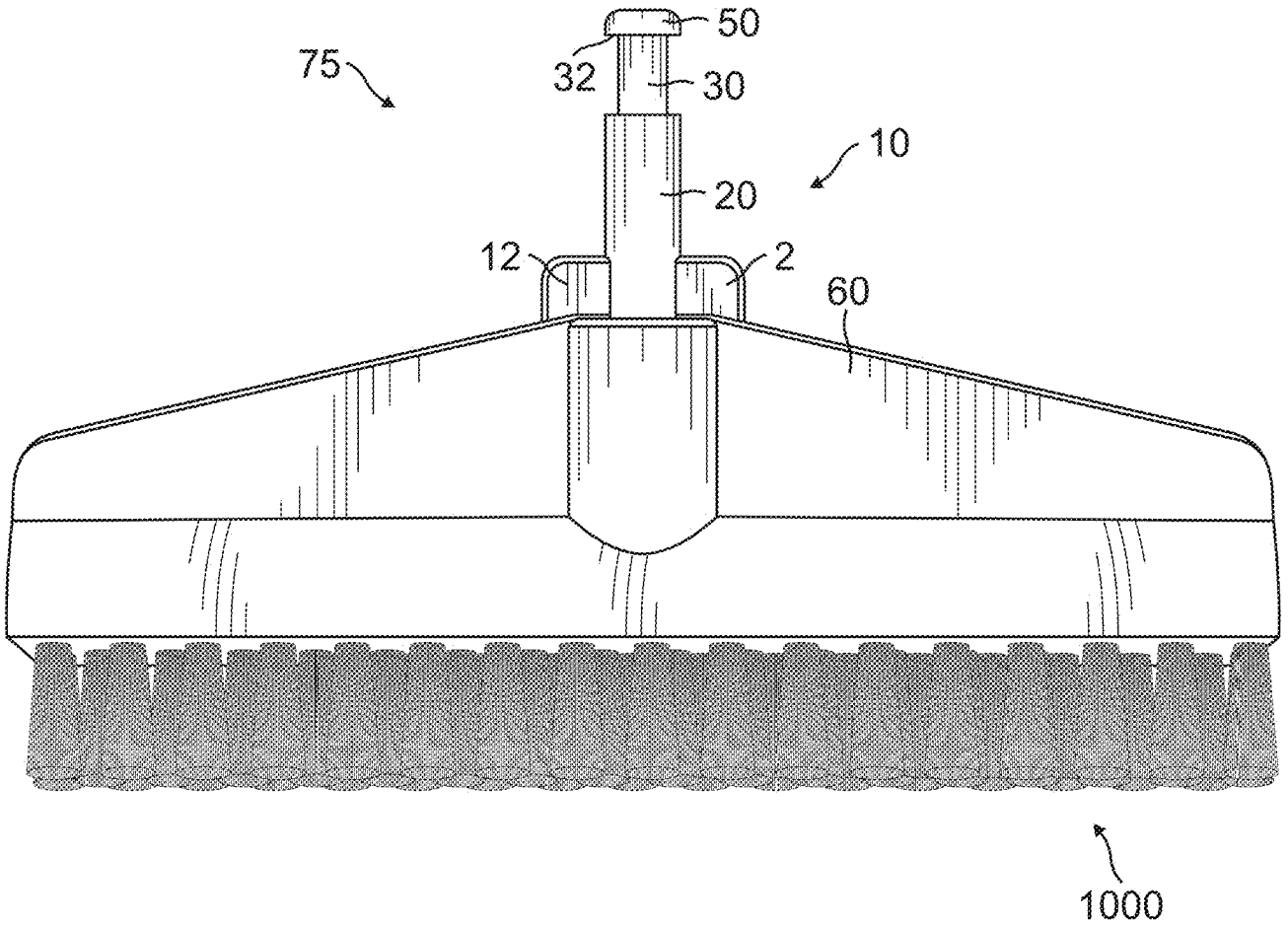
FIG. 10 is a side perspective view of a cleaning tool holder or bracket incorporating the quick release pin of the present invention and retaining a scrub brush.

Referring to FIG. 10, there is illustrated a side perspective view of a cleaning tool holder or bracket 60 incorporating the quick release pin 10 1000 of the present invention and retaining a scrub brush. Referring to FIG. 10, there is illustrated a side perspective view of a cleaning tool holder or bracket 60 incorporating the quick release pin 10 of the present invention and retaining a scrub brush 1000.

Figure 11:
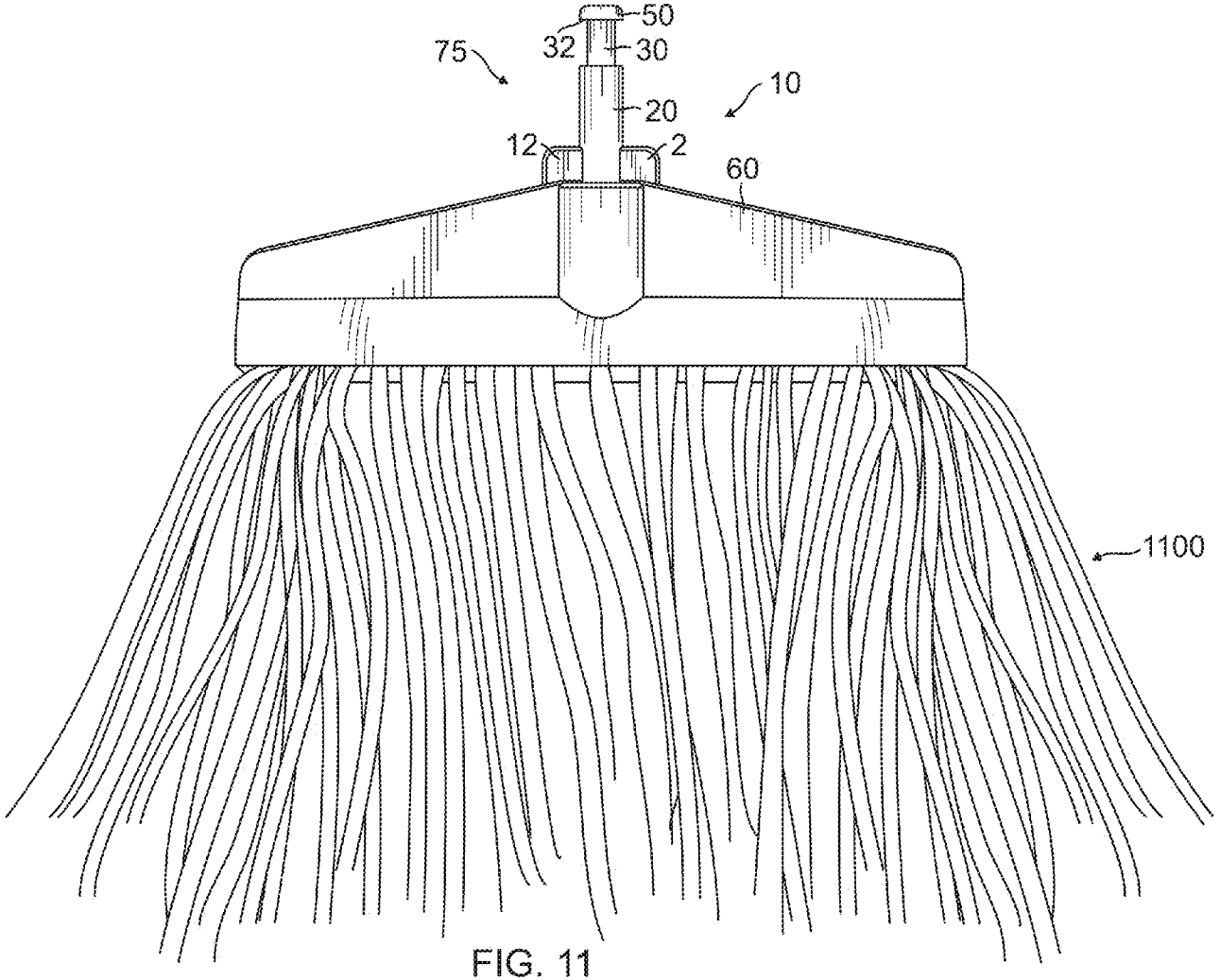
FIG. 11 is a side perspective view of a cleaning tool holder or bracket incorporating the quick release pin of the present invention and retaining a deck mop.

Referring to FIG. 11, there is illustrated a side perspective view of a cleaning tool holder or bracket 60 incorporating the quick release pin 10 of the present invention and retaining a deck mop 1100.

Figure 12:
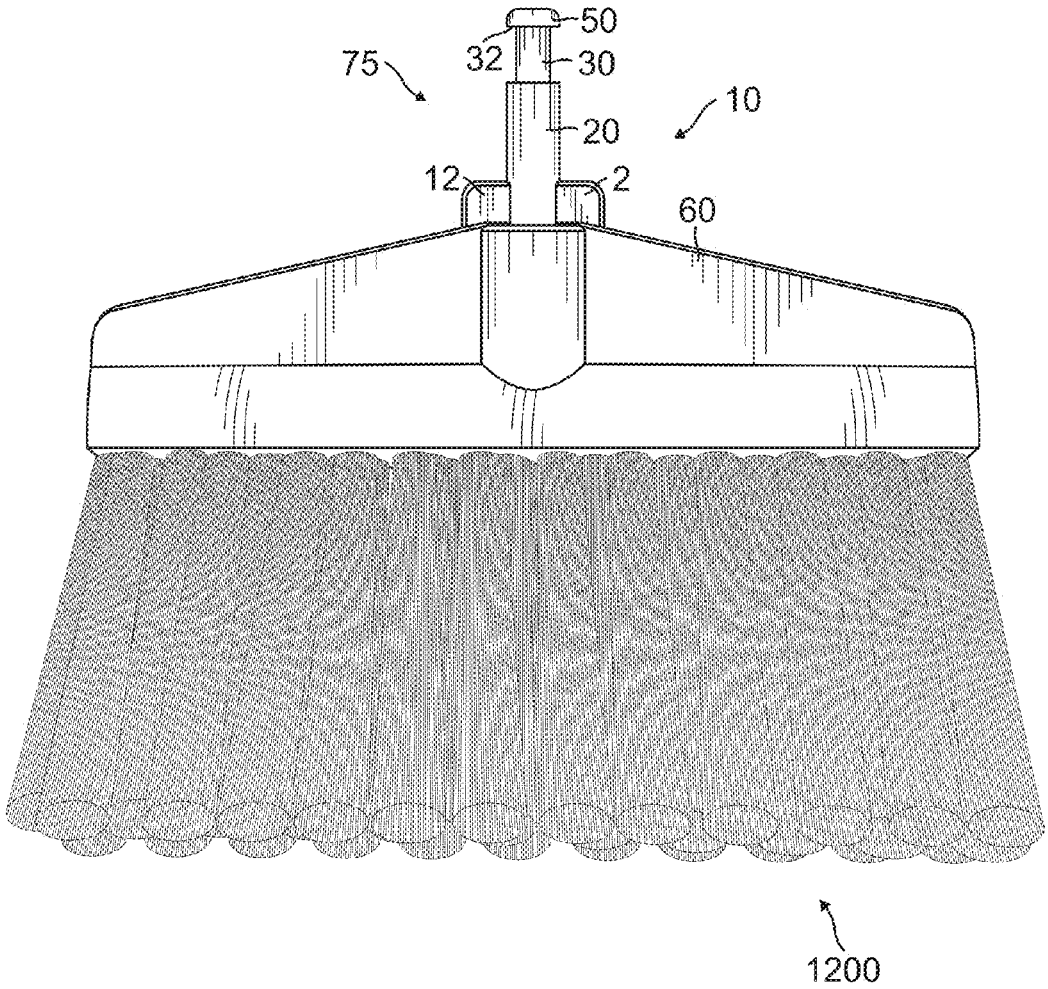
FIG. 12 is a side perspective view of a cleaning tool holder or bracket incorporating the quick release pin of the present invention and retaining a broom.

Referring to FIG. 12, there is illustrated a side perspective view of a cleaning tool holder or bracket 60 incorporating the quick release pin 10 of the present invention and retaining a broom 1200.

Figure 13:
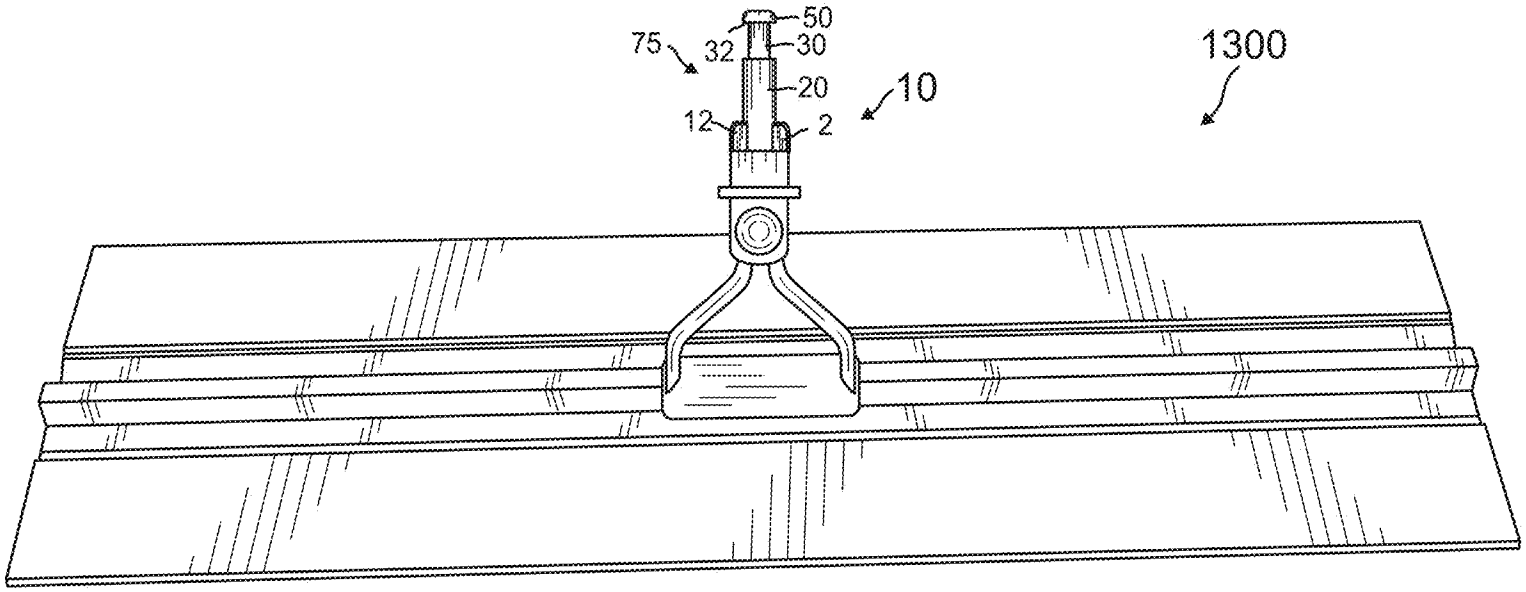
FIG. 13 is a side perspective view of a cleaning tool holder or bracket incorporating the quick release pin of the present invention and retaining a flat mop.

Referring to FIG. 13, there is illustrated a side perspective view of a cleaning tool holder or bracket 60 incorporating the quick release pin 10 of the present invention and retaining a flat mop 1300.

Figure 14:
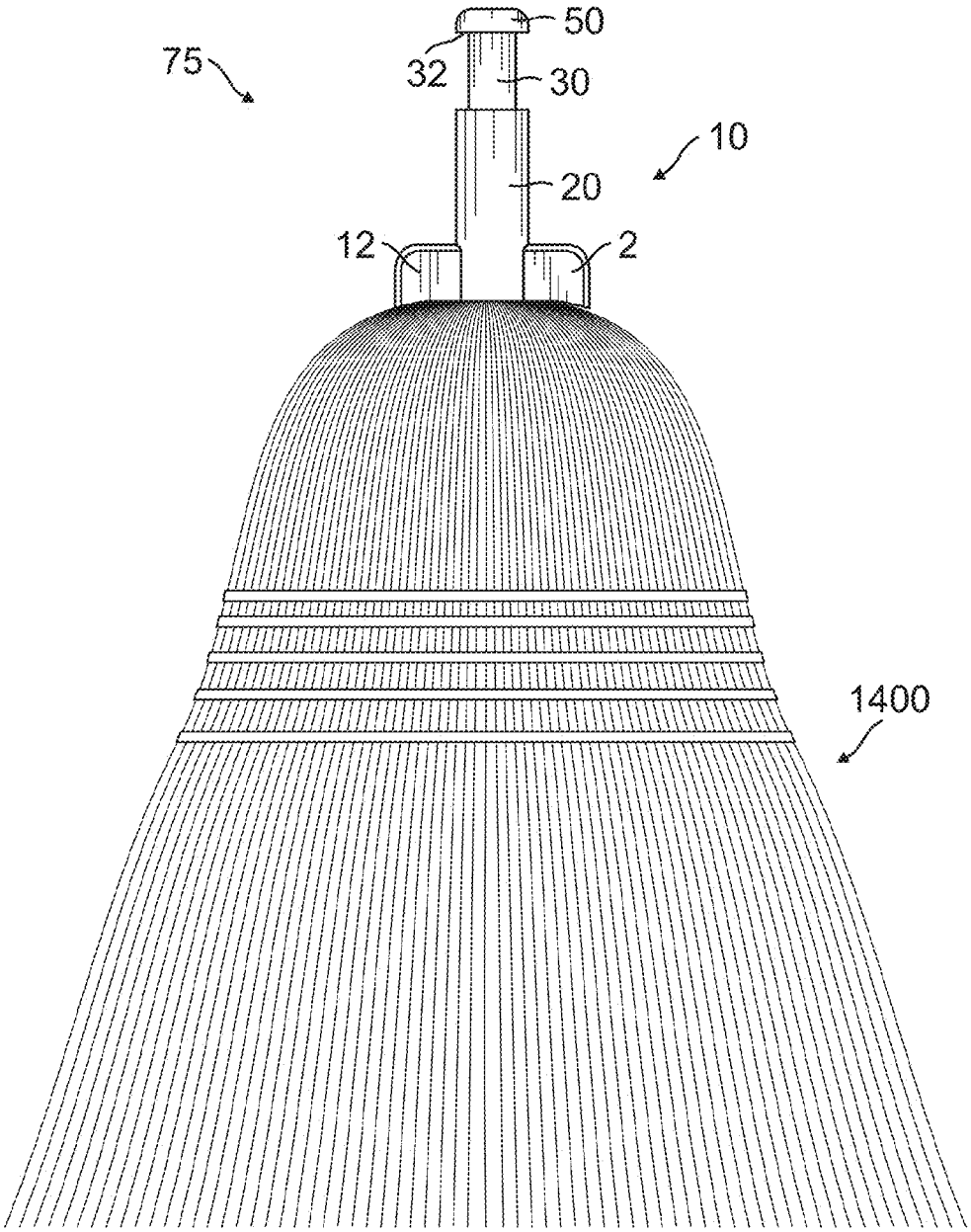
FIG. 14 is a side perspective view of a cleaning tool holder or bracket incorporating the quick release pin of the present invention and retaining a straw broom.

Referring to FIG. 14, there is illustrated a side perspective view of a cleaning tool holder or bracket 60 incorporating the quick release pin 10 of the present invention and retaining a straw broom 1400.

Figure 6:
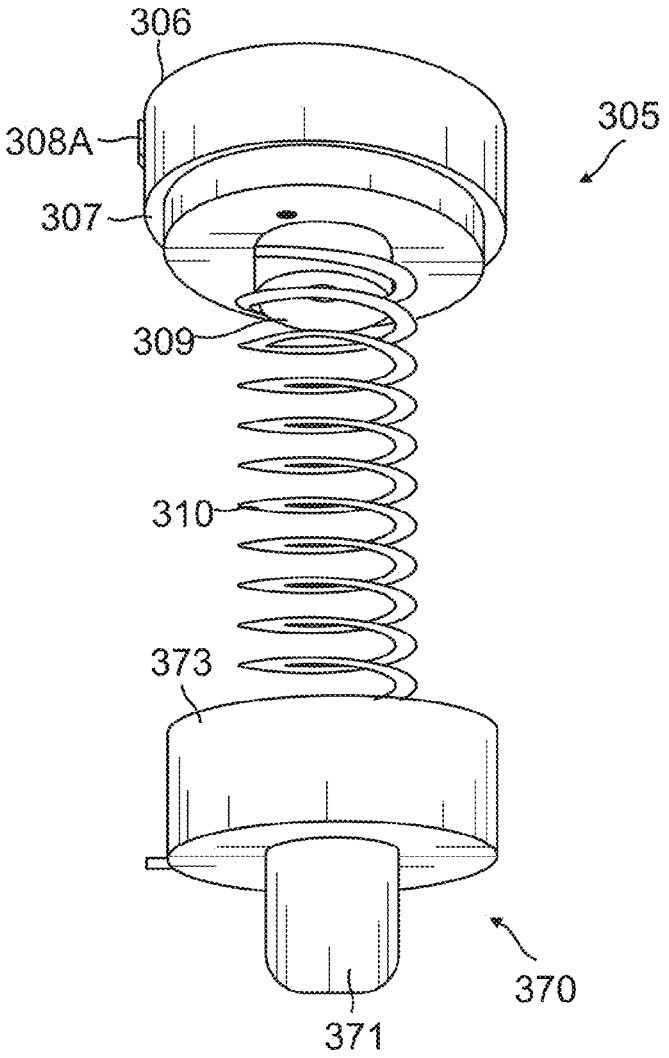
FIG. 6 is a side perspective view of the interior end wall retaining the vertical coil compression spring with the vertical piston at the opposite end of the vertical coil spring, the assembly removed from the cylindrical housing.

The quick release mechanism will now be described, first describing the internal components with reference to the cross sectional view of FIG. 18. Referring to FIG. 6, there is illustrated the interior end wall 305 having a bottom 306, a body 307 and a post 309 retaining one end of the vertical coil compression spring 310 with the vertical piston 370 having a body 373 and a piston post 371, the opposite end of the vertical coil compression spring 310 rests on lower post 375 (see FIG. 18) against body 373. A flange 308 extends transverse to interior end wall body 307 and extends through opening 301 in housing 300 where it is retained so that the interior end wall 305 will not move.

Figure 7:
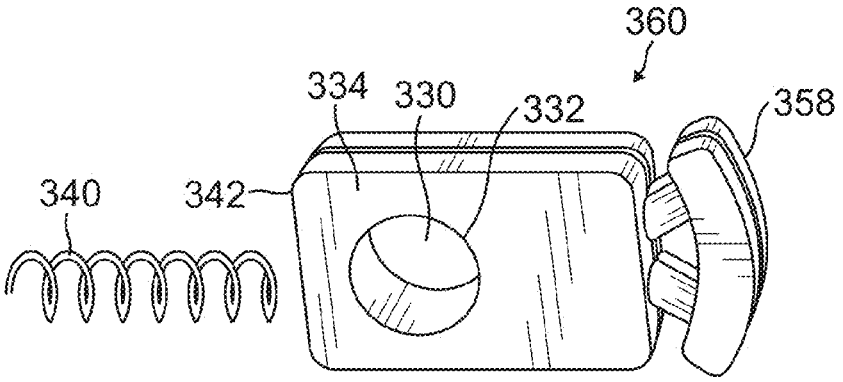
FIG. 7 is a closeup top and side exploded view of the pushbutton release mechanism and transverse coil spring removed from the cylindrical housing.
Figure 8:
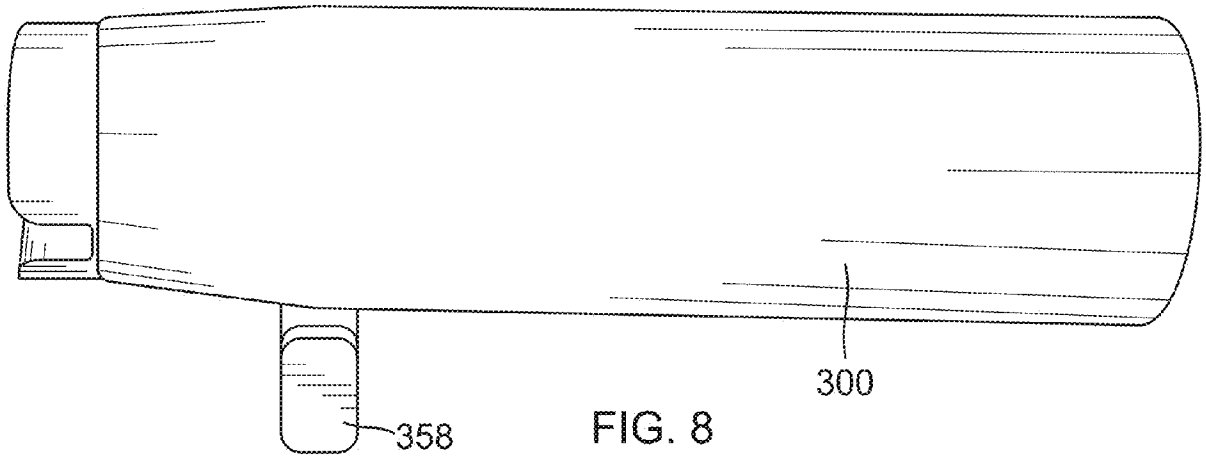
FIG. 8 is a side view of the cylindrical housing and the pushbutton extending therefrom.
Figure 9:
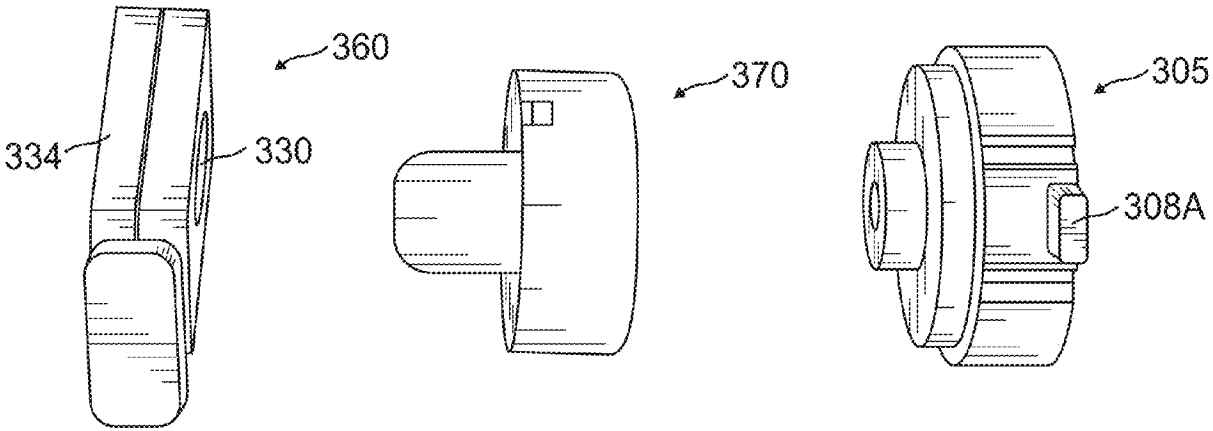
FIG. 9 is an exploded perspective view of some of the components that are within the cylindrical housing of the present invention.

Referring to FIG. 7, there is illustrated a closeup top and side exploded view of the pushbutton release mechanism 306 including a pushbutton 358 affixed to a pushbutton body 334 having a transverse opening 330 surrounded by an interior circumferential wall. A transverse coil spring 304 is retained between a proximal wall 343 of pushbutton body 334 and interior wall 351 of housing 300 (see FIG. 18). Referring to FIG. 8, the housing 300 is illustrated with the pushbutton 358. Referring to FIG. 9, there is illustrated previous described component interior end wall 305 with flange 308, vertical piston 370 and pushbutton 308 with pushbutton body 334 and transverse opening 330.

Figure 15:
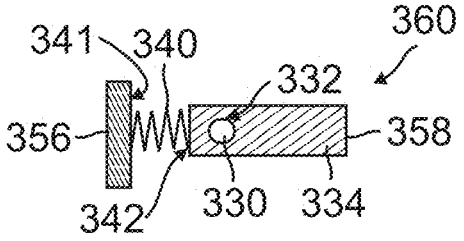
FIG. 15 is a cross-sectional view illustrating the transverse coil spring exerting a transverse force on the body of the transverse push pin and illustrating the opening within the body of the push pin.

The quick release mechanism will now be described. The quick release mechanism is retained in housing 300 having exterior wall 380 enclosing interior chamber 312. Within interior chamber 312 is fixed end wall 305 with post 309 retaining vertical coil compression spring 310 at one end and the second end of vertical coil spring 310 retained by lower post 375 of body 373 vertical piston 370. Also illustrated is piston post 371. Initially, the pushbutton assembly 360 is retained partially within interior chamber 312 with pushbutton 358 and a portion of pushbutton body 334 exterior to housing 380. Referring to FIG. 15 there is illustrated is a cross-sectional view illustrating the transverse coil spring 340 retained between interior wall 341 and proximal end 342 of pushbutton body 334 exerting a transverse force on the pushbutton body 334 of the transverse push pin 358 and illustrating the opening 330 within the pushbutton body 334 of the pushbutton 358.

Figure 16:
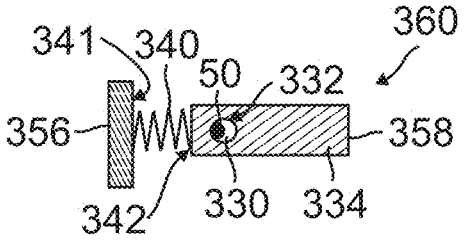
FIG. 16 is a cross-sectional view illustrating the transverse coil spring exerting a transverse force to cause a portion of the wall of the opening in the body of the transverse push pin to enter the gap within the quick release pin and retain the quick release pin within the cylindrical housing.
Figure 17:
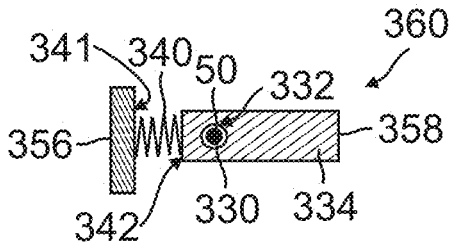
FIG. 17 is a cross-sectional view taken along Line A-A of FIG. 18 illustrating that a transverse force on the pushpin causes the transverse spring to be compressed so that the opening within the pushbutton is aligned with the piston and with the crown of the cleaning tool quick release pin to enable a force from the vertical spring to cause the vertical force of the piston on the top of the crown of the quick release pin to cause the quick release pin and its associated brace to be ejected from the cylindrical housing.

In operation, the quick release pin 10 is inserted through opening 308 in the bottom of housing until crown 50 is moved through and beyond open 330. Referring to FIG. 16, the transverse coil spring 340 exerts a transverse force to cause a portion of the wall 332 of the opening 330 in the body 334 of the transverse push pin assembly 360 to enter the gap 52 between lower surface 32 of crown 50 and upper surface 22 of lower cylinder 20 within the quick release pin 10 and retain the quick release pin 10 within interior chamber 312 of housing 380. The crown 50 pushes against piston post 371 to cause vertical coil spring 310 to be compressed. Referring to FIG. 17, a transverse force on the pushbutton 358 causes the transverse spring 340 to be compressed so that the opening 330 within the pushbutton body 334 is aligned with the piston post 371 and aligned with crown 50 so that vertical compression spring 310 exerts a downward force through piston post 371 against crown 50 causing crown 50 to be forced out of opening 330 and the entire quick release pushpin 10, tool holder 60 and retained cleaning implement to be pushed out of housing 380 as illustrated in FIG. 18.

To insert a replacement cleaning tool as illustrated in FIGS. 10 through 14, the quick release pushpin 10 is forced through opening 330 as retained in housing interior chamber 312 by the wall 332 of opening 330 and forced into the gap 52 of quick release pin 10. A force on pushbutton 358 causes the pushpin 10, tool holder 60 and cleaning tool to be released and pushed out of housing interior 312.

Figure 18:
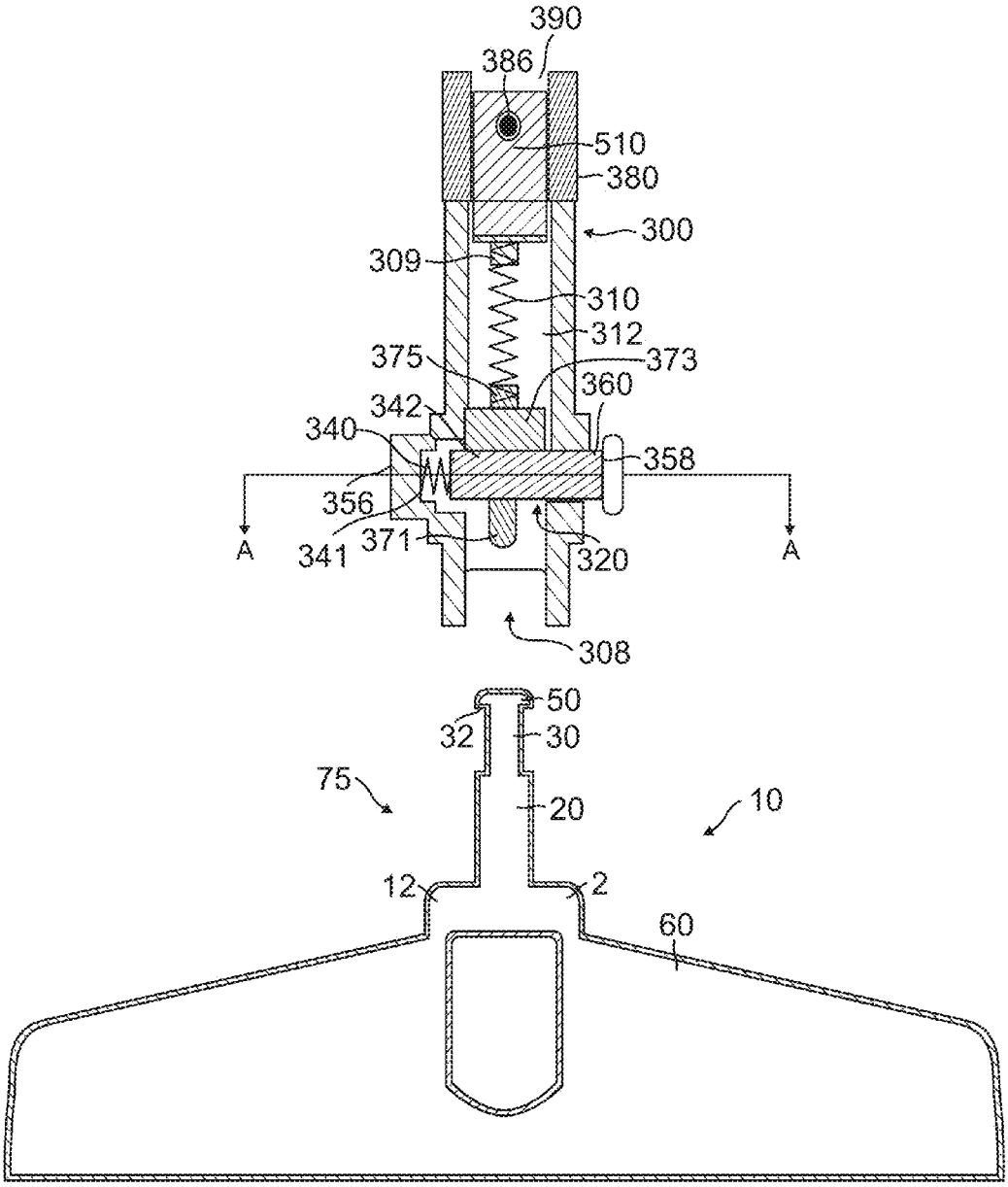
FIG. 18 is a cross-sectional and exploded view of the quick release mechanism of the present invention within the housing and the vertical spring in the uncompressed state with the retaining bracket or holder used to retain a cleaning tool and the quick release pin incorporated into the retaining bracket released from the quick release mechanism.
Figure 19:
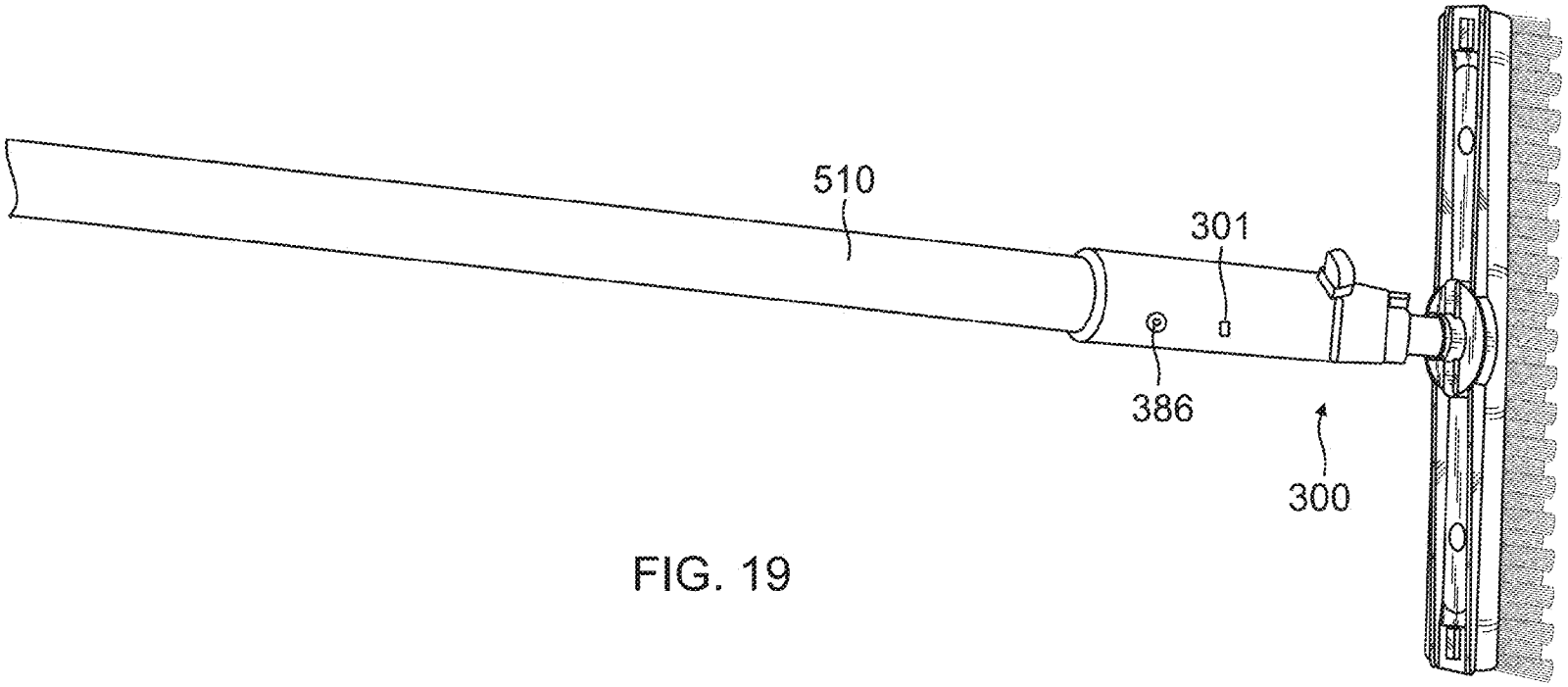
FIG. 19 is a perspective view of one of the cleaning tool attachments which is a scrub brush retained by the present invention quick release mechanism within and adjacent on side of the cylindrical housing and a handle retained at an opposite side of the cylindrical housing.

As illustrated in FIGS. 17 and 18, a lower portion of handle 510 is inserted through opposite end opening 390 of housing 380 and retained therein by pin or rivet 386.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

What is claimed is:

1. A quick release cleaning tool with a handle and a pushbutton release comprising:

a. a pushbutton release mechanism including an exterior vertical housing surrounding an interior vertical chamber, a lower portion of the handle positioned around the exterior vertical housing and retained to an interior vertical compression spring retaining block by a retaining member selected from the group consisting of a rivet and a pin, a first movable vertical piston and a first vertical compression spring between the vertical compression spring retaining block and the first movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton;

b. a molded brace containing a quick release pin that is affixed to a brace and extends away from the brace, the quick release pin having a first section integral with a wide section molded onto the brace, a second narrower section, a third section with a width as wide as the first section and a crown at the top of said section;

c. the quick release pin inserted through the opening in the pushbutton and the transverse compression spring in an uncompressed condition exerting a force causing the circumferential sidewall of the opening to be lodged in the second narrower section to lock the quick release pin and causing the first vertical compression spring to be in a compressed condition;

e. the pushbutton release is retained within a cylindrical housing which has a body with a vertical cutout through which the pushbutton is accessible; and f. a handle that is affixed to said cylindrical housing with said cylindrical housing having a pushbutton release that compresses the force of the transverse compression spring causing the opening in the pushbutton to move and disengage the quick release pin from the circumferential sidewall of the opening in the pushbutton, the crown is aligned with the movable piston and a force of the vertical compression spring causes the quick release pin to be ejected from said cylindrical housing and the quick release cleaning tool to be separated from said handle.

2. A quick release cleaning tool with a handle and a pushbutton release comprising: a pushbutton release mechanism including an exterior vertical housing surrounding an interior vertical chamber, a lower portion of the handle positioned around the exterior vertical housing and retained to an interior vertical compression spring retaining block by a retaining member selected from the group consisting of a rivet and a pin, a first movable vertical piston and a first vertical compression spring between the vertical compression spring retaining block and the first movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton.

3. The quick release cleaning tool in accordance with claim 2, further comprising: the quick release pin inserted through the opening in the pushbutton exerts a force causing the circumferential sidewall of the opening to be lodged in the second narrower section to lock the quick release pin and causing the first vertical compression spring to be in a compressed condition.

4. The quick release cleaning tool in accordance with claim 2, further comprising: a molded brace containing a quick release pin that is affixed to a brace and extends away from the brace, the quick release pin having a first section integral with a wide section molded onto the brace, a second narrower section, a third section with a width as wide as the first section and a crown at the top of said section.

5. The quick release cleaning tool in accordance with claim 2, further comprising: the pushbutton release is retained within a cylindrical housing which has a body with a vertical cutout through which the pushbutton is accessible; and a handle that is affixed to said cylindrical housing with said cylindrical housing having a pushbutton release that compresses the force of the transverse compression spring causing the opening in the pushbutton to move and disengage the quick release pin from the circumferential sidewall of the opening in the pushbutton, the crown is aligned with the movable piston and a force of the vertical compression spring causes the quick release pin to be ejected from said cylindrical housing and the quick release cleaning tool to be separated from said handle.

* * * * *